US012351953B2

(12) United States Patent
Kunzmann et al.

(10) Patent No.: US 12,351,953 B2
(45) Date of Patent: Jul. 8, 2025

(54) DOUBLE SELECTION FABRIC AND METHODS OF MAKING

(71) Applicant: BekaertDeslee Innovation BVBA, Waregem (BE)

(72) Inventors: Juergen Andreas Kunzmann, Winston-Salem, NC (US); Kara W. Pruitt, Greensboro, NC (US)

(73) Assignee: BEKAERTDESLEE INNOVATION BVBA (BE)

( * ) Notice: Subject to any disclaimer, the term of this patent is extended or adjusted under 35 U.S.C. 154(b) by 0 days.

(21) Appl. No.: 18/383,713

(22) Filed: Oct. 25, 2023

(65) Prior Publication Data

US 2024/0279851 A1 Aug. 22, 2024

Related U.S. Application Data

(60) Provisional application No. 63/447,204, filed on Feb. 21, 2023.

(30) Foreign Application Priority Data

Feb. 20, 2023 (BE) ..... 2023/5126

(51) Int. Cl.
*D04B 1/12* (2006.01)
*D04B 1/22* (2006.01)

(52) U.S. Cl.
CPC ..... *D04B 1/126* (2013.01); *D04B 1/22* (2013.01)

(58) Field of Classification Search
CPC . D04B 9/06; D04B 1/126; D04B 1/22; D04B 7/26; D04B 7/28; D04B 9/28; D04B 9/36
See application file for complete search history.

(56) References Cited

U.S. PATENT DOCUMENTS 4,353,229 A * 10/1982 Hutchinson ..... D04B 1/24 66/197
5,027,618 A * 7/1991 Robinson ..... D04B 1/22 66/195
5,299,435 A * 4/1994 Whalley ..... D04B 1/123 66/61

(Continued)

FOREIGN PATENT DOCUMENTS

GB 1577399 10/1980
JP S5287779 U 6/1977

*Primary Examiner* — Danny Worrell
(74) *Attorney, Agent, or Firm* — DINSMORE & SHOHL LLP

(57) ABSTRACT

A method of manufacturing a double selection fabric including a back layer, a front layer, and least a first and a second blister zone having different physical properties is provided, the method including: inserting in the first blister zone a first inlay yarn between the back layer and the front layer of the double selection fabric, and knitting a second inlay yarn to the back layer, wherein the second inlay yarn is different from the first inlay yarn; inserting in the second blister zone the second inlay yarn between the back layer and the front layer of the double selection fabric, and knitting the first inlay yarn to the back layer; and knitting the first and second inlay yarns to the back layer of the double selection fabric outside of the at least first and second blister zones. Double selection fabrics prepared by the methods are also provided.

10 Claims, 3 Drawing Sheets

(56) References Cited

U.S. PATENT DOCUMENTS

| | | | | |
|---|---|---|---|---|
| 5,887,451 | A * | 3/1999 | Suzuki | D04B 1/246 66/64 |
| 6,622,528 | B2 * | 9/2003 | Masse | D04B 9/28 66/196 |
| 7,536,879 | B2 * | 5/2009 | Vanwelden | D04B 1/126 66/196 |
| 10,174,445 | B2 * | 1/2019 | Brunton | D04B 1/123 |
| 10,626,529 | B2 * | 4/2020 | Brunton | D04B 9/38 |
| 10,662,558 | B2 * | 5/2020 | Vanwelden | D04B 1/126 |
| 10,912,340 | B2 * | 2/2021 | Diaz | D04B 1/108 |
| 11,441,247 | B2 * | 9/2022 | Kunzmann | D04B 1/123 |
| 2008/0236204 | A1 | 10/2008 | Vanwelden | |

* cited by examiner

Work
FIG. 1 – Prior Art
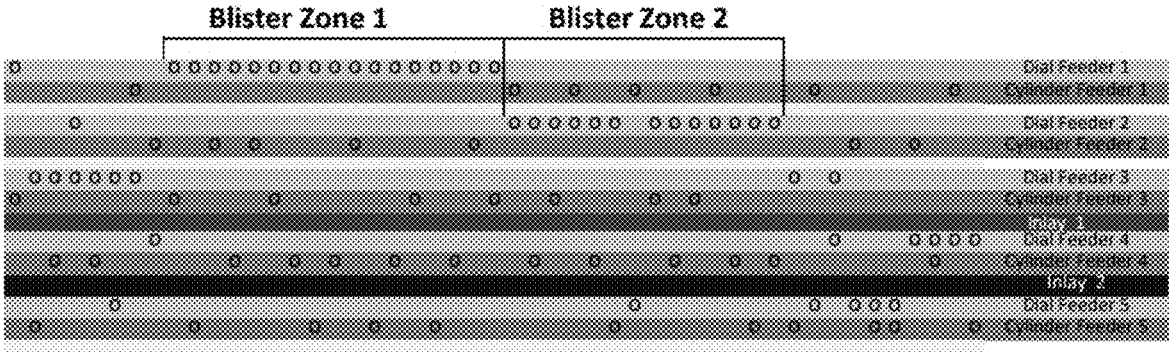
FIG. 2
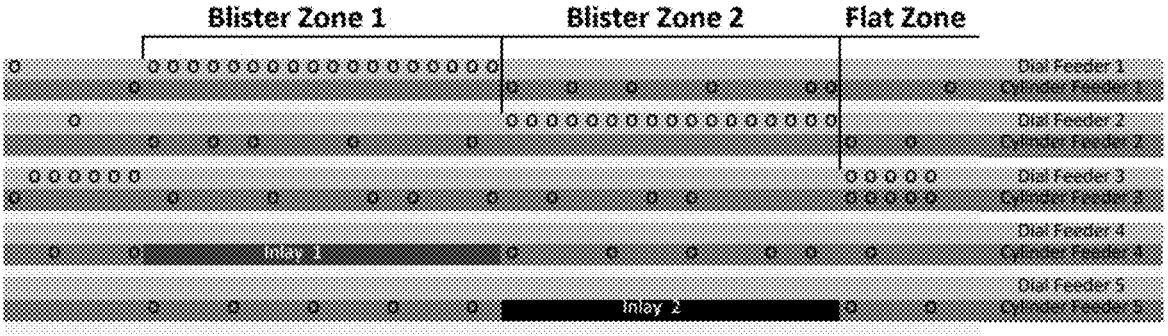

FIG. 3 – Prior Art

DOUBLE SELECTION FABRIC AND METHODS OF MAKING

CROSS REFERENCE TO RELATED APPLICATIONS

This application claims priority to U.S. Provisional Application Ser. No. 63/447,204, filed Feb. 21, 2023 and BE2023/5126, filed Feb. 20, 2023, each of which is incorporated herein by reference in its entirety.

FIELD

The present disclosure generally relates to a method of manufacturing a double selection fabric, with different blister zones having different appearances or physical properties. The method as herein disclosed is particularly useful in the manufacturing of a double selection fabric comprising large flat areas (e.g., "deep effect") alternating with blister (e.g., volume) areas, in particular with smaller flat or deep areas.

BACKGROUND

A double selection fabric (also called a double jersey knit fabric or wear) is a classical knit fabric that is knitted on a circular knitting machine, whereby the circular knitting machine is provided with a cylinder and a dial (that is positioned just above the cylinder), each provided with needles, the needles of the cylinder typically being provided for knitting the front of the fabric, and the needles of the dial typically being provided for knitting the back of the fabric.

In a double selection circular knitting machine, the needles of the cylinder and the dial are independently driven by an electronic pattern mechanism, through which every single needle of the cylinder/dial can be selected to either knit, miss or tuck, thereby creating the possibility to produce a design on the front and the back of the fabric.

Usually lay-in yarns are added in between the dial and the cylinder in order to give volume to these double jersey knit wears, for instance when it is used as mattress ticking. In such zones where front and back are not knitted together, generally referred to as blister zones, the inlay yarn present throughout the fabric will create a voluminous appearance.

Unfortunately, the presence of the inlay yarn that is permanently laid in between the back and front layers causes limitations in creating flat/deep areas. If the flat areas are too large, the inlay pushes through the front layer and creates defects known as "popping out inlay." Furthermore, it allows for only one color of inlay yarn, either a white inlay yarn or a dyed inlay yarn.

It is an objective of the present disclosure to address the aforementioned restrictions by a new method of creating a double selection fabric with multiple blister zones having different appearances or physical properties.

SUMMARY

Accordingly, provided herein are methods of making a double selection fabric that minimize fabric defects and provide a fabric having multiple blister zones of differing appearances.

In one embodiment, a method is provided to produce a double selection fabric comprising a back and a front layer and at least a first and a second blister zone with different properties, said method comprising the use of at least a first and a second different inlay yarn, wherein: in the first blister zone, the first inlay yarn is inserted between the back and front layer of the double selection fabric and the second different inlay yarn is knitted to the back layer; wherein in the second blister zone the second different inlay yarn is inserted between the back and front layer of the double selection fabric and the first inlay yarn is knitted to the back layer; and wherein the first and second different inlay yarns are knitted to the back layer of the double selection fabric outside of said at least first and second blister zones.

In another embodiment, a double selection fabric is provided, comprising a back and a front layer and at least a first and a second blister zone of different properties, wherein: in the first blister zone, a first inlay yarn is laying in between the back and front layer of the double selection fabric and a second different inlay yarn is knitted to the back layer; in the second blister zone, the second different inlay yarn is laying in between the back and front layer of the double selection fabric and the first inlay yarn is knitted to the back layer; and the first and second different inlay yarns are knitted to the back layer of the double selection fabric outside of said at least first and second blister zones.

In another embodiment, a double selection fabric is provided, comprising a back and a front layer and at least a first and a second blister zone of different colors, said fabric comprising at least a first and second colored inlay yarn, wherein: in the first colored blister zone, the first colored inlay yarn is inserted between the back and front layers of the double selection fabric and the second colored inlay yarn is knitted to the back layer; in the second colored blister zone, the second colored inlay yarn is inserted between the back and front layers of the double selection fabric and the first colored inlay yarn is knitted to the back layer; and the first and second colored inlay yarns are knitted to the back layer of the double selection fabric outside of said at least first and second blister zones.

BRIEF DESCRIPTION OF THE DRAWINGS

Further aspects of the present disclosure will be more readily appreciated upon review of the detailed description of its various embodiments, described below, when taken in conjunction with the accompanying drawings.

FIG. 1 is a part of a row of a knitting pattern of a prior art embodiment of a double selection fabric that is knitted on a double selection circular knitting machine, and wherein the knit fabric is built up out of 3 yarns, and two inlay yarns that are added in-between the dial and the cylinder, thus floating between the layers across the fabric.

FIG. 2 is a part of a row of a knitting pattern of an embodiment of a double selection fabric according to the disclosure that is knitted on a double selection circular knitting machine, and wherein the knit fabric is built up out of 3 yarns, and two inlay yarns added by means of the cylinder feeders. This method of introducing the inlays allows that In Blister Zone 1, inlay 1 is selected to lay loose between the layers, and that in Blister Zone 2, inlay 2 is selected to lay loose between the layers. In the flat area no inlay yarns are selected to be present in-between the layers.

Figure 3:
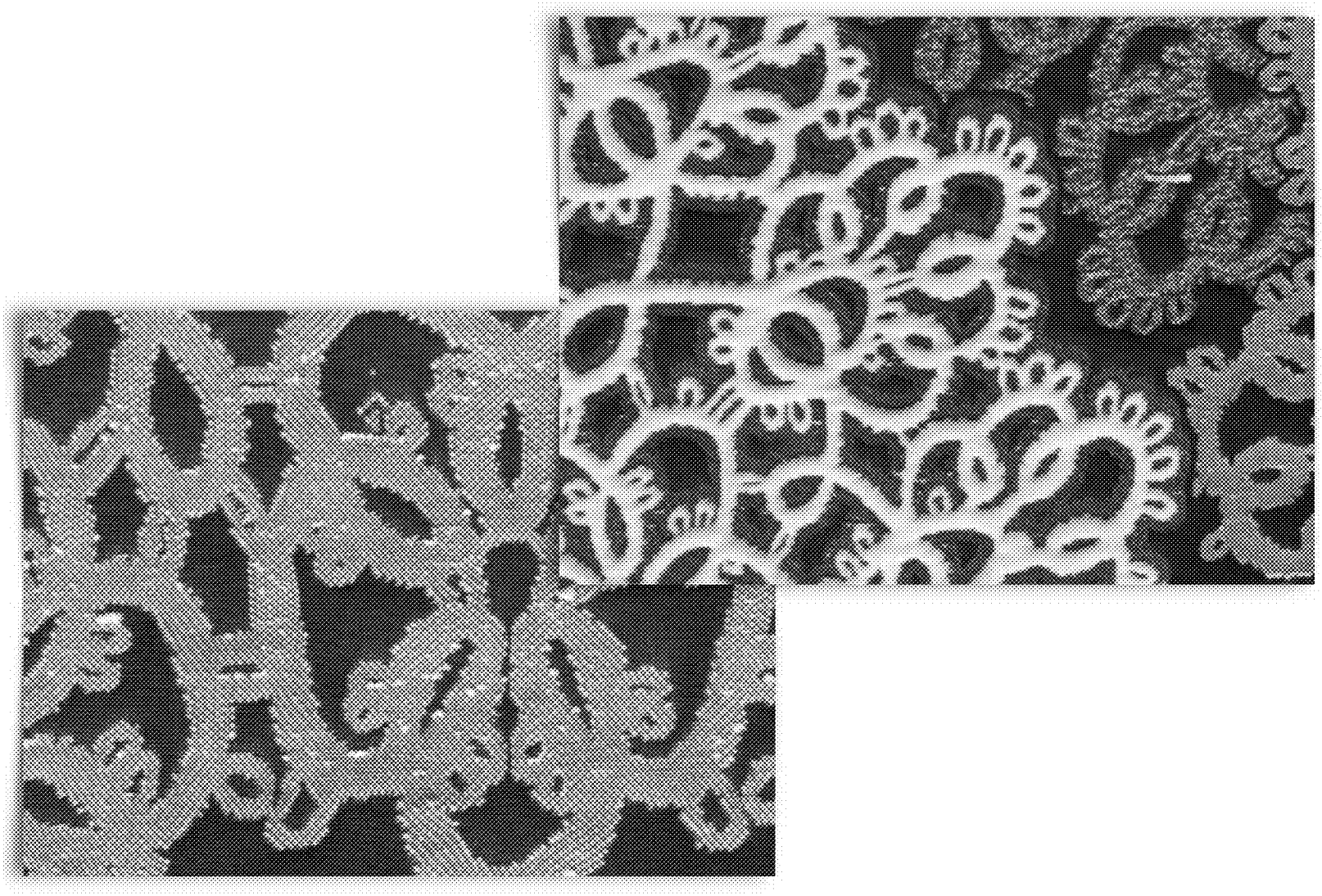
FIG. 3 illustrates popping of the inlay in the flat areas using the prior art method.
Figure 4:
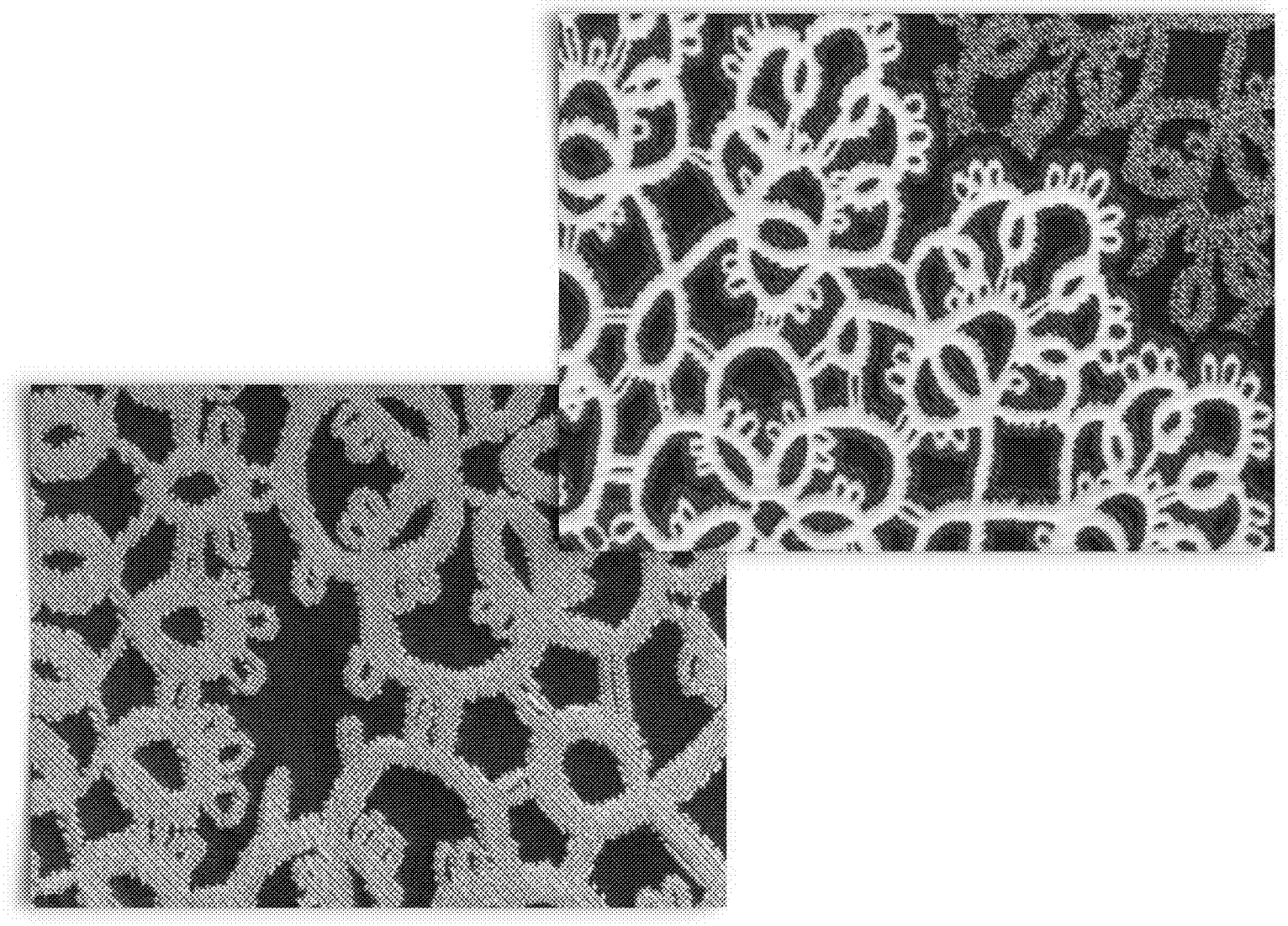
FIG. 4 illustrates the lack of popping of the inlay in the flat areas using the method of the present disclosure.

The drawings illustrate only example embodiments and are therefore not to be considered limiting of the scope described herein, as other equally effective embodiments are within the scope and spirit of this disclosure. The elements and features shown in the drawings are not necessarily drawn to scale, emphasis instead being placed upon clearly illustrating the principles of the embodiments. Additionally, certain dimensions may be exaggerated to help visually convey certain principles. In the drawings, similar reference numerals between figures designate like or corresponding, but not necessarily the same, elements.

DETAILED DESCRIPTION

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, specific embodiments of methods and materials are now described.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of textile engineering, material science, and the like, which are within the skill of the art. In accordance with the purpose(s) of the present disclosure, as embodied and broadly described herein, embodiments of the present disclosure, in some aspects, relate generally to knitted spacer fabrics having multiple fabric constructions in a single fabric.

It is to be understood that, unless otherwise indicated, the present disclosure is not limited to particular materials, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise.

As further detailed hereinafter, the method of the present invention allows a practitioner to insert inlay yarns into a blister pocket or to take it out and to work with different properties (in particular different colors) of inlay yarn that is inserted based on the blister zone with a desired property, in particular a blister zone with a desired color.

"Blister" refers to a voluminous zone of a double selection fabric where back/front are not knitted together. "Inlay yarn" is laying in, used to fill up the voluminous zones, or blisters. In conventional techniques, inlay yarn lays in between the front and back layer and does not form a stitch/loop.

In conventional knitting methods the inlay yarn lays as a permanent yarn in between the back and front layer to create a voluminous appearance. Doing this restricts the fabric from having a lot of flat/deep effects, as these would cause the popping through of the inlay yarn.

In embodiments of the presently disclosed method, the inlay yarn will be taken away from laying in between the back and front layer, which enables production of a very voluminous fabric in combination with large areas of deep effect. The larger areas with deep effect will not have any inlay yarn laying in between the front and back layer. In said areas the inlay yarn(s) are knitted to the back layer instead.

The method of the disclosure has been found particularly useful to create a fabric with high contrast colored zones, e.g., white and black in a very saturated appearance. The white blister zone will have a white inlay yarn behind and the black inlay yarn lays behind the dark blister zones. If a black inlay yarn is used to lay in between the back and front layer, the white inlay yarn will not lay in between the back and front layer in the same design area, and vice versa.

Furthermore, the disclosed methods allow for increased amounts of inlay yarn per blister zone laying in between the back and front layer. For example, if a blister zone is a relatively larger area, the amount of inlay can be increased to fill out the pocket, and can be vice versa reduced if the pocket is a relatively smaller size and doesn't require the same amount of inlay to fill the pocket.

In embodiments, if the inlay yarn is not intended to lay in between the front and back layer to create voluminous blister areas, the inlay is knitted to the backside of the fabric.

It is an object of the present disclosure to address the problems associated with different colored inlays mentioned above. Hereto, the present disclosure provides a method to produce a double selection fabric comprising a back and a front layer and at least a first and a second blister zone, the blister zones having different physical properties, said method comprising the use of at least a first and second different inlay yarn, wherein:

- in the first blister zone, the first inlay yarn is inserted between the back and front layers of the double selection fabric and the second different inlay yarn is knitted to the back layer;
- in the second blister zone, the second different inlay yarn is inserted between the back and front layers of the double selection fabric and the first inlay yarn is knitted to the back layer; and
- the first and second different inlay yarns are knitted to the back layer of the double selection fabric outside of said at least first and second blister zones.

Appreciating the possibility of selectively knitting the inlay yarns to the back of the fabric, the disclosed methods allow the practitioner to choose and select a first inlay yarn of a desired property to be inserted into a first blister pocket and to take it out and work with a second different inlay yarn of another property to be inserted in a second blister zone. As used herein, blister zones with different properties is meant to refer blister zones with different properties influenced by the properties of the inlay yarns being used. As is generally known, inlay yarns may be used to modify one or more of the following properties of a knitted structure: stability, elastic stretch and recovery, handle, weight, surface interest, and visual appearance.

Thus in one embodiment, the properties of the inlay yarns are matched to the desired properties of the blister zone, wherein the properties of the first inlay yarn and the second inly yarn are different. In an embodiment, the properties of the first inlay yarn are matched to the desired properties of the first blister zone. In an embodiment, the properties of the second inlay yarn are matched to the desired properties of the second blister zone. In a particular embodiment of the method according to the disclosure, the properties of the first inlay yarn are matched to the desired properties of the first blister zone, and the properties of the second inlay yarn are matched to the desired properties of the second blister zone, wherein the properties of the first inlay yarn and the second inlay yarn are different.

In a particular embodiment, the blister zones with different properties are blister zones with different visual appearances, for example, blister zones of different colors. In said embodiment, the first inlay yarn and the second inlay yarn have a different visual appearance, in particular a different color.

The present invention accordingly provides a method to produce a double selection fabric comprising a back layer and a front layer and at least a first and a second blister zone of different visual appearances, said method comprising the use of at least a first and a second inlay yarn of different visual appearances, wherein:

- in the first blister zone, the first inlay yarn is inserted between the back layer and the front layer of the double selection fabric and the second inlay yarn of different visual appearance is knitted to the back layer;
- in the second blister zone, the second inlay yarn of different visual appearance is inserted between the back layer and the front layer of the double selection fabric and the first inlay yarn is knitted to the back layer; and
- the first and second inlay yarns of different visual appearances are knitted to the back layer of the double selection fabric outside of said at least first and second blister zones.

In a specific embodiment, the present disclosure provides a method to produce a double selection fabric comprising a back layer and a front layer and at least a first and a second blister zone of different colors, said method comprising the use of at least a first and a second colored inlay yarn, wherein:

- in a first colored blister zone, the first colored inlay yarn is inserted between the back and front layers of the double selection fabric and a second colored inlay yarn is knitted to the back layer;
- in the second colored blister zone, the second colored inlay yarn is inserted between the back and front layers of the double selection fabric and the first colored inlay yarn is knitted to the back layer; and
- the first and second colored inlay yarns are knitted to the back layer of the double selection fabric outside of said at least first and second blister zones.

In said embodiment wherein the difference between the blister zones is a difference in visual appearance, the visual appearance, in particular the color, of the first inlay yarn is matched to the desired visual appearance, in particular the desired color, of the first blister zone. To the same extent, the visual appearance, in particular the color, of the second inlay yarn is matched to the desired visual appearance, in particular the desired color, of the second blister zone. In a specific embodiment of the method according to the disclosure, the visual appearance, in particular the color, of the first inlay yarn is matched to the desired visual appearance, in particular the desired color, of the first blister zone, and the visual appearance, in particular the color, of the second inlay yarn is matched to the desired visual appearance, in particular the desired color, of the second blister zone. Matching of the colors does not necessarily imply that the colors should be the same. As long as the colors don't contradict each other they can be considered as matching colors, for example a (dark) black blister zone can have a dark blue inlay yarn as matching color, or an off-white blister zone can have a white inlay yarn as matching color. In a particular embodiment, the matching colors are the same, i.e. the color, of the first inlay yarn is the same as the desired color of the first blister zone, and the color of the second inlay yarn is the same as the desired color of the second blister zone.

It will be evident to the skilled person that the aforementioned methods are not restricted to a fabric with only two different blister zones, but that it can equally be applied to a fabric comprising a plurality of blister zones with different properties. In each of said blister zones with different properties, an inlay yarn that matches with the desired properties of said blister zone is floating between the layers whilst at least one different inlay yarn that matches with the desired properties of another blister zone within the fabric, is knitted to back layer of said blister zone.

Again, the method is particularly useful to prepare a fabric comprising a plurality of blister zones with different visual appearances, in particular with different colors, even more in particular for a fabric in which at least one dark and one light colored zone occur. Using the method of the disclosure, a first dark colored inlay will be floating behind a dark blister zone and a second lighter colored inlay will be used behind a light colored blister zone, wherein the inlay yarn (first or second) that is not intended to lay in between the front and back layer in the blister area, is knitted to the backside of the fabric.

Using this approach, designs can be created with large areas of flat/deep appearance as there is not any inlay yarn laying in between the front and back layers to create voluminous areas.

These areas can be combined with zones of voluminous appearance within the same fabric knitted in one production process.

Thus in a specific embodiment, the first blister zone is dark colored and the second blister zone is a light colored area, with the first inlay yarn being a dark colored inlay yarn and the second inly yarn being a light colored inlay yarn, or vice versa. In embodiments, the colors of the first and second blister zones are contrasting colors. In embodiments, dark colored blister zones and/or inlay yarns may include black, navy blue, brown, dark grey, or other colors having relatively dark values on a color value scale. In embodiments, light colored blister zones and/or inlay yarns may include white, off-white, cream, beige, tan, yellow, or other colors having relatively light values on a color value scale.

In a second aspect, the present disclosure provides a double selection fabric obtained using the methods as herein disclosed, in particular the method to produce a double selection fabric comprising a back layer and a front layer and at least a first and a second blister zone of different visual appearance, said method comprising the use of at least a first and a second inlay yarn of different visual appearances, wherein:

- in the first blister zone, the first inlay yarn is inserted between the back layer and the front layer of the double selection fabric and the second inlay yarn of different visual appearance is knitted to the back layer;

in the second blister zone, the second inlay yarn of different visual appearance is inserted between the back layer and the front layer of the double selection fabric and the first inlay yarn is knitted to the back layer; and the first and second inlay yarns of different visual appearances are knitted to the back layer of the double selection fabric outside of said at least first and second blister zones.

In a third aspect, the present disclosure provides a double selection fabric comprising a back layer and a front layer and at least a first and a second blister zone with different properties, said double selection fabric being characterized in that:

in the first blister zone, a first inlay yarn is inserted between the back layer and the front layer of the double selection fabric and a second different inlay yarn with different properties is knitted to the back layer;

in the second blister zone, the second different inlay yarn is inserted between the back layer and the front layer of the double selection fabric and the first inlay yarn is knitted to the back layer; and the first and second different inlay yarns are knitted to the back layer of the double selection fabric outside of said at least first and second blister zones.

In an embodiment, a double selection fabric is provided, comprising a back layer and a front layer and at least a first and a second blister zone with different visual appearances, said double selection fabric being characterized in that:

in the first blister zone, a first inlay yarn is inserted between the back layer and the front layer of the double selection fabric and a second different inlay yarn with different visual appearance is knitted to the back layer;

in the second blister zone, the second different inlay yarn is inserted between the back layer and the front layer of the double selection fabric and the first inlay yarn is knitted to the back layer; and the first and second different inlay yarns are knitted to the back layer of the double selection fabric outside of said at least first and second blister zone.

In a particular embodiment the present disclosure provides a double selection fabric comprising a back layer and a front layer, at least a first and a second blister zone of different colors, and at least a first and second colored inlay yarn, wherein:

in the first colored blister zone, the first colored inlay yarn is inserted between the back layer and the front layer of the double selection fabric and the second colored inlay yarn is knitted to the back layer;

in the second colored blister zone, the second colored inlay yarn is inserted between the back layer and the front layer of the double selection fabric and the first colored inlay yarn is knitted to the back layer; and the first and second colored inlay yarns are knitted to the back layer of the double selection fabric outside of said at least first and second blister zone.

The fabric described herein can be made using a double selection circular knitting machine having three-way capabilities in one or both of the cylinder and the dial. Three-way capabilities refer to the dial, the cylinder, or both being fitted to perform knit, float, and tuck stitches. The fabric can be made using a two-way (knit/float) dial and a three-way (knit/tuck/float) cylinder, a two-way (knit/float) cylinder and a three-way (knit/tuck/float) dial, or both a three-way dial and a three-way cylinder. In some embodiments, the needles of the knitting machine can be set such that the cylinder can knit the front side of the fabric and the dial can knit the back side of the fabric. In some embodiments, the needles can be set such that the dial can knit the front side of the fabric and the cylinder can knit the back side of the fabric. Characterizing for the method according to the invention and as mentioned above, is the introduction of at least two different fill-in or inlay yarns across the fabric, wherein the positioning of the inlay is controlled by the design of the back side of the fabric, i.e., the selection of needles to knit the appropriate inlay to the back.

This method according to the disclosure is particularly suitable for knitting double jersey mattress ticking, but equally useful in the manufacture of upholstery or garments such as shoe wear, sportswear, or other garments. In a specific embodiment, the double selection fabric according to embodiments of the disclosure is a mattress ticking.

Further aspects of the embodiments described herein are provided by the subject matter of the following numbered clauses:

1. A method of producing a double selection fabric comprising a back layer, a front layer, and at least a first and a second blister zone having different physical properties, the method comprising:
   inserting in the first blister zone a first inlay yarn between the back layer and the front layer of the double selection fabric, and knitting a second inlay yarn to the back layer, wherein the second inlay yarn is different from the first inlay yarn;
   inserting in the second blister zone the second inlay yarn between the back layer and the front layer of the double selection fabric, and knitting the first inlay yarn to the back layer; and
   knitting the first and second inlay yarns to the back layer of the double selection fabric outside of said at least first and second blister zones.
2. The method according to clause 1, wherein the different physical properties of the at least first and second blister zones are selected from stability, elastic stretch and recovery, handle, weight, surface, and visual appearance.
3. The method according to clause 1, wherein the at least first and second blister zones are different colors the first and second inlay yarns are different colors, such that:
   in the first colored blister zone the first colored inlay yarn is inserted between the back layer and the front layer of the double selection fabric and the second colored inlay yarn is knitted to the back layer;
   in the second colored blister zone the second colored inlay yarn is inserted between the back layer and the front layer of the double selection fabric and the first colored inlay yarn is knitted to the back layer; and
   the first and second colored inlay yarns are knitted to the back layer of the double selection fabric outside of said at least first and second blister zones.
4. The method according to clause 3, wherein the first colored inlay yarn matches the color of the first blister zone.
5. The method according to clause 3, wherein the second colored inlay yarn matches the color of the second blister zone.
6. The method according to clause 3, wherein the first colored inlay yarn matches the color of the first blister zone and the second colored inlay yarn matches the color of the second blister zone.
7. A double selection fabric obtained by the method according to any of the preceding clauses.

8. The double selection fabric according to clause 7, wherein the double selection fabric is a mattress ticking.

9. A double selection fabric comprising a back layer, a front layer, and at least a first blister zone and a second blister zone having different physical properties, wherein:

in the first blister zone, a first inlay yarn is disposed between the back layer and the front layer of the double selection fabric and a second inlay yarn is knitted to the back layer, wherein the second inlay yarn is different from the first inlay yarn;

in the second blister zone, the second inlay yarn is disposed between the back layer and the front layer of the double selection fabric and the first inlay yarn is knitted to the back layer; and the first and second inlay yarns are knitted to the back layer of the double selection fabric outside of said at least first and second blister zones.

10. A double selection fabric comprising a back layer, a front layer, and at least a first and a second blister zone having different colors, wherein:

in the first colored blister zone, a first colored inlay yarn is inserted between the back layer and the front layer of the double selection fabric and a second colored inlay yarn is knitted to the back layer, wherein the second colored inlay yarn is different from the first colored inlay yarn;

in the second colored blister zone, the second colored inlay yarn is inserted between the back layer and the front layer of the double selection fabric and the first colored inlay yarn is knitted to the back layer; and the first and second colored inlay yarns are knitted to the back layer of the double selection fabric outside of said at least first and second blister zones.

It is stressed that the particulars in the aforementioned description are by way of example and for purposes of illustrative discussion of the different embodiments of the present disclosure only. They are presented in the cause of providing what is believed to be the most useful description of the principles and conceptual aspects of the invention. In this regard no attempt is made to show structural details of the invention in more detail than is necessary for a fundamental understanding of the invention. The skilled artisan will appreciate that other embodiments are contemplated and possible in view of the present disclosure and drawings.

The invention claimed is:

1. A method to produce a double selection fabric comprising a back layer, a front layer, a flat area, and at least a first and a second blister zone with different properties, said method comprising the use of at least a first and a second inlay yarn, wherein the first and second inlay yarns are different from each other, and wherein:

in the first blister zone, the first inlay yarn is inserted between the back and front layers of the double selection fabric and the second inlay yarn is knitted to the back layer;

in the second blister zone, the second inlay yarn is inserted between the back and front layers of the double selection fabric and the first inlay yarn is knitted to the back layer; and in the flat area, the first and second inlay yarns are knitted to the back layer of the double selection fabric outside of said at least first and second blister zones.

2. The method according to claim 1, wherein the different properties of the first and second blister zones are selected from stability, elastic stretch and recovery, handle, weight, surface, and visual appearance.

3. The method according to claim 1, wherein the different properties of the first and second blister zones are different colors and the first and second inlay yarns are different colors.

4. The method according to claim 3, wherein the first inlay yarn is matched to the color of the first blister zone.

5. The method according to claim 3, wherein the second inlay yarn is matched to the color of the second blister zone.

6. The method according to claim 3, wherein the first inlay yarn is matched to the color of the first blister zone and wherein the second inlay yarn is matched to the color of the second blister zone.

7. A double selection fabric obtained using the method according to claim 1.

8. The double selection fabric according to claim 7, wherein the double selection fabric is a mattress ticking.

9. A double selection fabric comprising a back layer, a front layer, a flat area, and at least a first and a second blister zone of different properties, wherein:

in the first blister zone, a first inlay yarn is laying in-between the back and front layers of the double selection fabric and a second inlay yarn is knitted to the back layer, the second inlay yarn being different from the first inlay yarn;

in the second blister zone, the second inlay yarn is laying in-between the back and front layers of the double selection fabric and the first inlay yarn is knitted to the back layer; and in the flat area, the first and second inlay yarns are knitted to the back layer of the double selection fabric outside of said at least first and second blister zones.

10. A double selection fabric comprising a back layer, a front layer, a flat area, and at least a first colored blister zone and a second colored blister zone, wherein the first and second colored blister zones are different colors, and at least a first and second colored inlay yarn, wherein:

in the first colored blister zone, the first colored inlay yarn is inserted between the back and front layers of the double selection fabric and the second colored inlay yarn is knitted to the back layer;

in the second colored blister zone, the second colored inlay yarn is inserted between the back and front layers of the double selection fabric and the first colored inlay yarn is knitted to the back layer; and in the flat area, the first and second colored inlay yarns are knitted to the back layer of the double selection fabric outside of said at least first and second colored blister zones.

* * * * *